United States Patent [19]

Gaitten, deceased

[11] Patent Number: 4,509,574

[45] Date of Patent: Apr. 9, 1985

[54] FEED ROLL SPIKES WITH PLUS-SHAPED CUTTING EDGES

[75] Inventor: Walden M. Gaitten, deceased, late of Sylacauga, Ala., by Dorothy A. Gaitten, executrix

[73] Assignee: Kockums Cancar, Corp., Talladega, Ala.

[21] Appl. No.: 559,815

[22] Filed: Dec. 9, 1983

[51] Int. Cl.[3] ..... B27L 1/00

[52] U.S. Cl. ..... 144/208 E; 144/246 F; 198/624

[58] Field of Search ..... 144/208 E, 246 R, 276 C, 144/246 F; 198/624, 625, 692

[56] References Cited

U.S. PATENT DOCUMENTS

| | | | |
|---|---|---|---|
| 2,857,945 | 10/1958 | Brundell et al. . | |
| 2,860,672 | 11/1958 | Brundell et al. . | |
| 2,875,715 | 3/1959 | Reece . | |
| 2,893,453 | 7/1959 | Brundell et al. . | |
| 2,897,859 | 8/1959 | Annis, Jr. | 144/246 F |
| 2,903,027 | 9/1959 | Edgemond, Jr. et al. . | |
| 3,171,455 | 3/1965 | Brundell et al. . | |
| 3,228,439 | 1/1966 | Jonsson et al. . | |
| 4,257,461 | 3/1981 | Wangeby et al. | 144/246 F |

*Primary Examiner*—W. D. Bray

*Attorney, Agent, or Firm*—Cushman, Darby & Cushman

[57] ABSTRACT

An improvement in a debarking machine of the type including an annular frame, a plurality of debarking tools mounted in annularly spaced relation within the annular frame for rotation together about the axis of the annular frame and for movement toward and away from each other, infeed and outfeed mechanisms for feeding logs through the annular frame so that the tools will engage the exterior periphery of the successive logs and strip the bark therefrom during their movement through the annular frame. The infeed and outfeed mechanisms each include three driven spiked rolls arranged so that their spiked peripheries normally engage the exterior periphery of the log in centered relation and move the same axially through the annular frame for debarking by the tools. Each of the spiked rolls includes a cylinder and a multiplicity of spikes extending radially outward therefrom. The improvement comprises constructing each of the spikes in at least one of the rolls and preferably all so as to provide a radially outward cutting edge disposed generally within a plane parallel with the plane of the cylinder. Each cutting edge is configured to define at least one line extending transverse to the direction of movement thereof on the roll and a second line extending transverse to the first line. Each spike divergingly tapers from the lines in a direction toward the exterior of said cylinder.

18 Claims, 4 Drawing Figures

FEED ROLL SPIKES WITH PLUS-SHAPED CUTTING EDGES

This invention relates to debarking machines and more particularly to improvements in debarking machines of the type described in U.S. Pat. No. 2,857,945 issued Oct. 28, 1958 to P. B. Brundell et al.

The Brundell et al. patent discloses an annular frame having mounted on the central portion thereof a plurality of tools capable of moving radially inwardly and outwardly toward and away from one another while being rotated together about the axis of the annular frame. At the inlet side of the frame there is provided three infeed rolls of a construction which includes a multiplicity of conical spikes extending outwardly from a cylindrical periphery. The rolls are mounted on the annular frame for pivotal movement together toward and away from one another about axes which are parallel with the longitudinal axis of the annular frame. The rotational axis of each roll extends perpendicular to its pivotal axis. At the outfeed side of the annular frame there are provided three outfeed rolls of similar conical spike configuration mounted about the same pivotal axes as the infeed rolls and having their axes of rotation perpendicular to their pivotal axis. Each set of three rolls is normally spring urged into an innermost position and are movable outwardly in response to engagement of a log end therewith. As the infeed rolls move the log through the central portion of the annular frame, the tools are likewise moved away from one another. In operation, the tools are normally urged to move inwardly so as to press against the surface of the log being debarked with an intensity such that the tips penetrate the bark and continuously ride on the wood surface of the log despite irregularities of log contour and bark. A wood contacting edge of each tool tip is sufficiently blunt so as not to unduly damage the wood. As the leading end of the log moves into the outfeed side of the annular frame having been debarked, it engages the outfeed rollers which move apart to accommodate the periphery of the log and then serve to feed the log axially outwardly.

While the Brundell et al. debarker has proven to be an effective piece of equipment in operation, one problem which is presented in the normal operation of the device relates to the effect of wear on the performance of the infeed and outfeed rolls. Specifically, the infeed and outfeed rolls are constructed of cylindrical members having a multiplicity of spikes fixed to the periphery thereof. The spikes are arranged in rows extending transversely across the periphery of the cylindrical member with corresponding spikes of each row being transversely aligned. The log engaging outer end of each spike is of conical configuration and the area of contact of the conical ends of the spikes within the log determine the feeding torque applied to the log by the rolls in normal operation. Experience has shown that the conical tips of the spikes tend to wear into a more-or-less flat configuration, the flattening extending in the direction of rotary movement. Once the tips of the spikes start to wear into a flattened blade-like wearing pattern, their ability to transmit feeding torque is detrimentally affected and the wear tends to take place with a snowballing effect. This snowballing effect results from the fact that as wear occurs, slippage is more likely to occur and as more and more slippage occurs the extent of wear is increased.

It is an object of the present invention to provide improvements in the configuration of the spikes utilized in the feed rolls so as to obviate the snowballing wear characteristics heretofore noted. In accordance with the principles of the present invention this objective is achieved by constructing each of the spikes so as to provide a radially outward cutting edge disposed generally within a plane parallel with the plane of the cylinder upon which they are mounted. The cutting edge is configured to define at least one line extending transverse to the direction of movement thereof on the roll and a second line extending transverse to the first line. The spike divergingly tapers from the lines in a direction toward the exterior of the cylinder to which the spikes are attached.

Preferably, the two transversely extending lines which define the cutting edge of each spike are in the configuration of a plus. With this arrangement one of the crosses of the plus is aligned in a plane passing through the axis of rotation of the roll and the other is aligned within a plane perpendicular thereto. With this configuration, the aforesaid slippage incident to the utilization of spikes having conical tips is prevented by virtue of the transversely extending cutting edge. Likewise, the spike provides a much more stable contact with the log, preventing transverse movement, due to the other perpendicularly arranged cutting edge. Of particular significance is that the divergingly tapered configuration of the spikes from these plus shaped cutting edges is inducive to the application of greater feeding torques to the log by virtue of the greater surface area of the log engaged by the spike tips. Moreover, the arrangement is such that the edges are self-sharpening in response to wear in a manner which does not materially affect the area of contact nor does it induce increased slippage and wear. Finally it will be noted that the configuration is such as to prevent the wedging of material therebetween, such as ice or the like.

In order to reduce the cost involved in producing and mounting the spikes having the aforesaid improved cutting edge configuration, it is preferable to form a plurality of spikes as a single casting. A preferred embodiment is to cluster five spikes together arranged so that two pairs of spikes are disposed respectively in two adjacent rows of spikes and the fifth spike is disposed in a third row adjacent to one of the two adjacent rows. With this arrangement it is preferable that the fifth spike be centered transversely with respect to each of the two pairs and that the first pair be spaced apart transversely a distance greater than the transverse spacing between the second pair. With this arrangement not only is the cost of production enhanced but the resultant roll presents the log engaging spikes in a series of annularly spaced transversely extending rows in which the spikes of alternate rows are staggered with respect to one another, rather than being transversely aligned as has been the practice heretofore in conjunction with the provision of conical spikes.

Moreover, with an arrangement of this type it becomes economically feasible to fix the clusters of cast spikes on the exterior periphery of the cylinder by removable fastening means, enabling the spikes to be easily replaced when worn to the point of no further practical use.

Accordingly it is a further object of the present invention to provide a debarking machine having feed rolls formed with spikes of improved configuration which is simple in construction, effective in operation and economical to manufacture and maintain.

These and other objects of the present invention will become more apparent during the course of the following detailed description and appended claims.

The invention may best be understood with reference to the accompanying drawings wherein an illustrative embodiment is shown.

Figure 1:
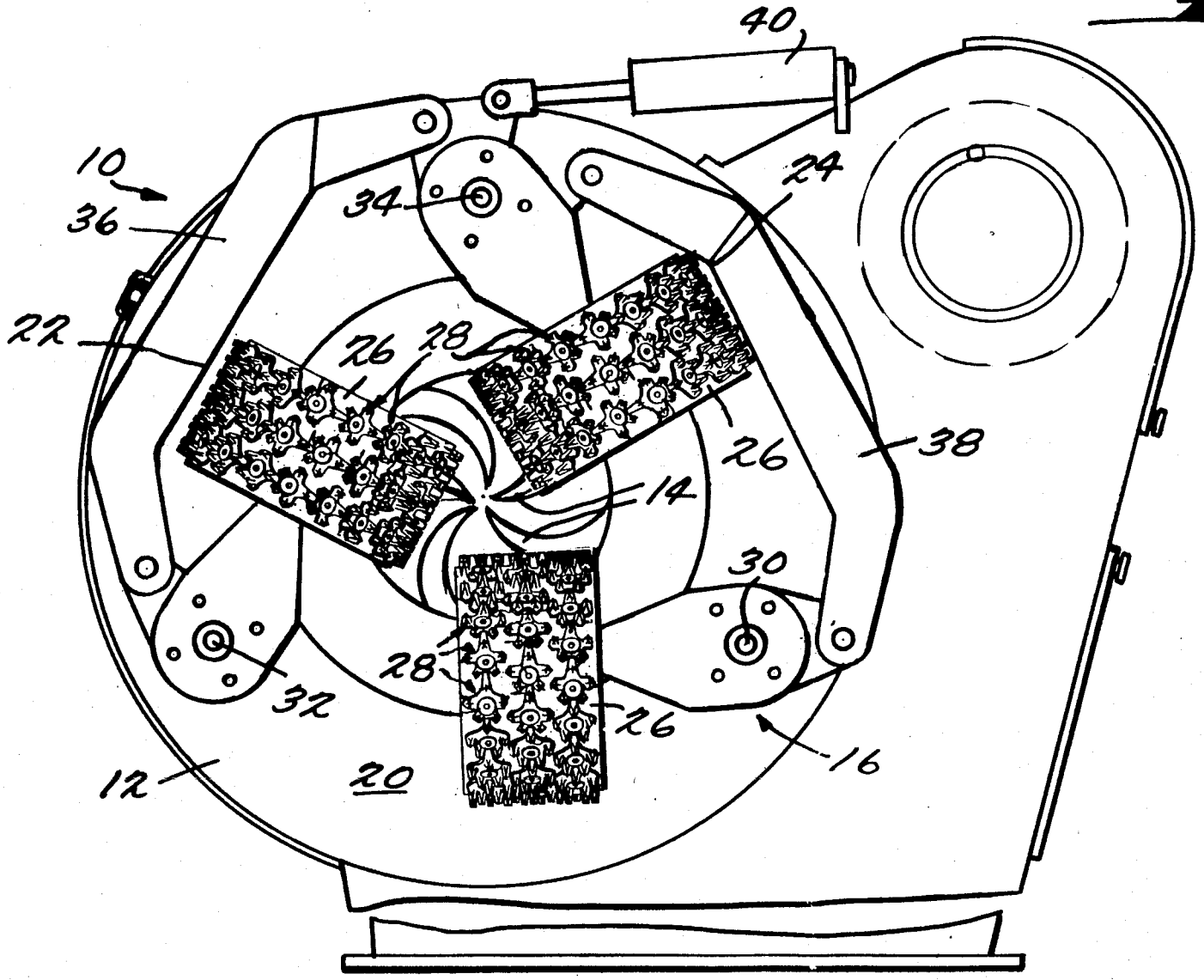
FIG. 1 is a front elevational view of a debarking machine embodying the principles of the present invention.
Figure 2:
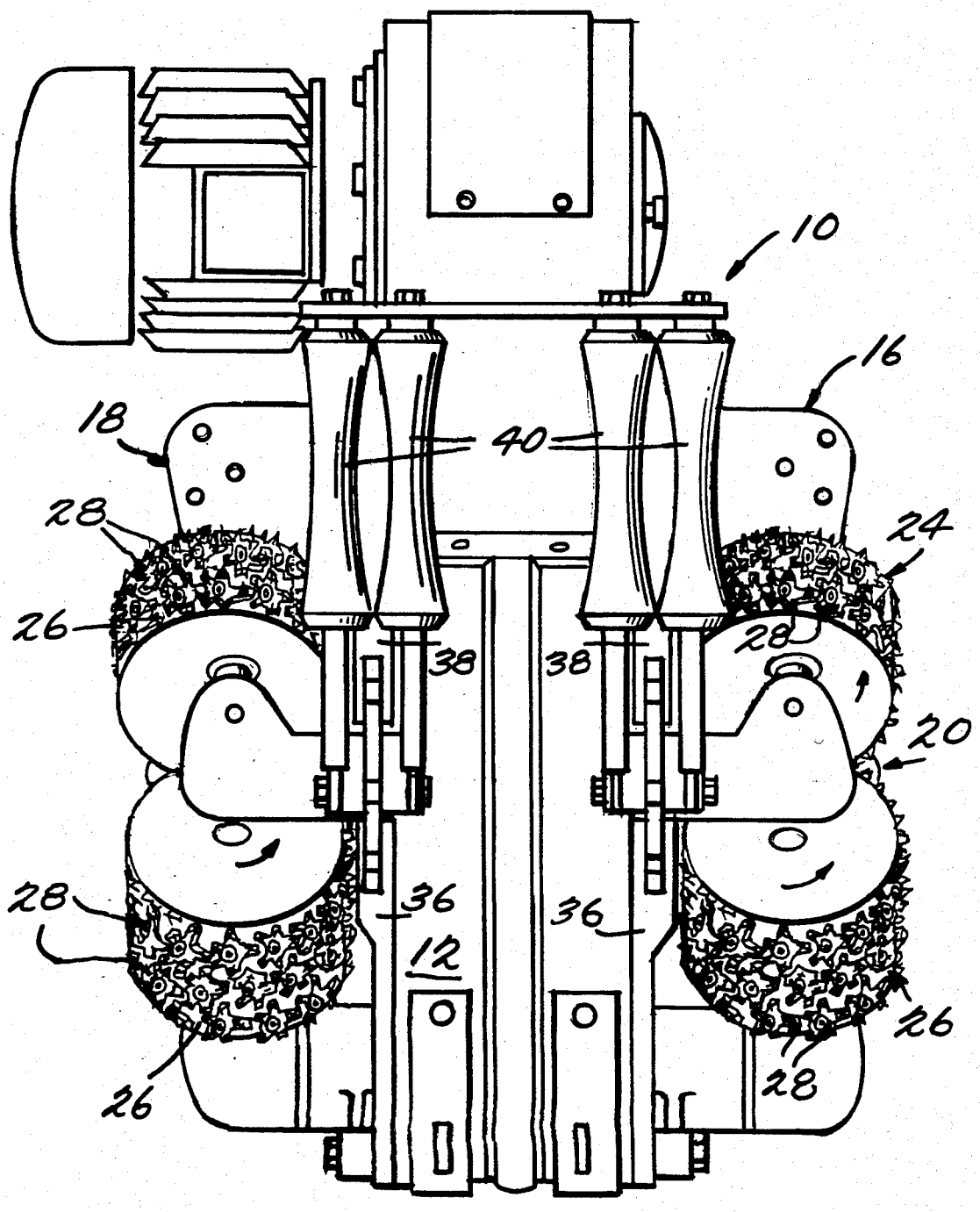
FIG. 2 is a side elevational view of the debarking machine shown in FIG. 1.

Referring now more particularly to FIGS. 1 and 2, there is shown therein a debarking machine, generally indicated at 10, which has embodied therein the improvements of the present invention. As previously indicated, the debarking machine is preferably of the type disclosed in commonly-assigned U.S. Pat. No. 2,857,945, the disclosure of which is hereby incorporated by reference into the present specification. Other related patents disclosing variations in the debarking machine include the following, the disclosure of each of which is hereby incorporated by reference into the present specification: U.S. Pat. Nos. 2,875,715; 2,860,672; 2,893,453; 2,903,027; 3,171,455; and 3,228,439.

The improvements of the present invention relate specifically to one of the basic components of the debarking machine and consequently the present specification will be concerned with the details of construction of the improvements and how they relate to the basic component in which they are embodied and how the improvements enhance the operative relationship between the improved components and the other basic components of the debarking machine. Consequently, the details of construction of the other components of the machine will not be specifically described, it being understood that reference may be had to any of the above-noted patents in order to obtain whatever detailed understanding is required.

The basic components of the debarking machine include an annular frame assembly, generally indicated at 12. Mounted within the annular frame assembly 12 for rotation together about the axis of the annular frame and for movement toward and away from each other is a plurality of annularly spaced debarking tools 14. The tools 14 are normally biased into their innermost position and are capable of moving outwardly in response to the engagement of a log end therewith so that the inner cutting ends of the tools will engage the periphery or bark of a log passing therethrough and remove the same as the tools are rotated together about the axis of the annular frame.

An infeed mechanism, generally indicated at 16, and an outfeed mechanism, generally indicated at 18, are provided on opposite sides of the annular frame assembly for feeding successive logs through the annular frame so that the tools will engage the exterior periphery of successive logs and strip the bark therefrom during their movement through the annular frame.

The outfeed mechanism 18 is similar in construction and operation with the infeed mechanism 16. The improvements of the present invention are embodied in the spike configuration of the rolls which make up both the infeed mechanism and the outfeed mechanism. Since the construction of both mechanisms is the same, the details of construction will be recited with respect to the infeed mechanism with the understanding that the outfeed mechanism is similarly constructed.

As shown in FIGS. 1 and 2 of the drawings, the infeed mechanism 16 includes three feed rolls, 20, 22 and 24. Each of the feed rolls is constructed similarly of a cylindrical member 26 having spike means, generally indicated at 28, embodying the principles of the present invention embodied in the exterior periphery thereof.

Each of the infeed rolls 20, 22 and 24 is power driven for rotational movement about the axis of the associated cylinder 26. In this regard it will be noted that the axes of the cylinders are disposed within a common plane which is perpendicular to the axis of the annular frame 12. Moreover, the three infeed rolls are positioned so that roll 20 has its axis disposed below the axis of the annular frame 12. The infeed roll 20 is power driven in a direction such that its upper periphery moves in a direction toward the tools 14, as indicated by the arrow shown in FIG. 1. The infeed rolls 22 and 24 are positioned in corresponding equally annularly spaced relation about the axis of the annular frame and each is power driven so that the spikes on the periphery thereof move inwardly toward the tools as they reach the closest position toward the axis of the annular frame. Stated differently, the three infeed rolls are power driven to rotate in a direction to cooperatively engage the periphery of a log and feed the same in a direction toward the tools 14 and through the annular frame 12 in generally coaxial relation therewith.

The infeed rolls 20, 22 and 24 are also mounted on the annular frame for simultaneous swinging movement about annularly spaced axes 30, 32 and 34 respectively, so that the cooperating log engaging spiked peripheries thereof will move toward and away from one another or toward and away from the axis of the annular frame 12. In order to effect simultaneous pivotal movement of the three infeed rolls, a pair of connecting links 36 and 38 is provided which extend respectively between the rolls 22 and 24, and rolls 24 and 20. In accordance with the teachings contained in the Brundell et al. patent, a pair of spring devices 40 is connected between the annular frame assembly 12 and the infeed roll 24 so as to resiliently bias roll 24 together with rolls 20 and 22 into their innermost positions with respect to one another.

As stated in the Brundell et al. patent, the operation of the infeed rolls is such that when a properly aligned log end is fed into engagement with the cooperating spiked peripheries of the infeed rolls 20, 22 and 24, the rolls move outwardly by a pivotal movement about axes 30, 32 and 34 against the resilient bias of spring assembly 40 by virtue of the engagement of the associated spike means 28 with the log end and the direction of power driven movement thereof. As the infeed rolls continue to rotate with the spike means 28 thereof in engagement with the bark or exterior periphery of the log, the log is moved along its axis in a direction toward the tools 14 and through the annular frame along its axis. As the log moves through the annular frame, tools 16 move outwardly and engage the bark or periphery of the log as it moves along its axis through the annular frame, thus removing the bark as the tools rotate together in engagement therewith. When the debarked end of the log engages the outfeed mechanism 18, the rolls thereof, which are power driven and operate similar to the infeed rolls, engage the log end and move outwardly and their continued rotational movement serves to feed the debarked log further along its axis until the entire log has been debarked by the tools 14 and moved away from the annular frame by the outfeed mechanism 18.

As previously indicated, the improvements of the present invention relate to the construction of the spike means 28 which is embodied in at least one of the infeed rolls, and preferably all of the infeed rolls as well as the comparable outfeed rolls.

In the preferred embodiment shown, the spike means 28 is in the form of an investment or shell casting containing a cluster of five individual spikes 42, 44, 46, 48 and 50. As shown, each of the individual spikes is interconnected by a central body portion 52 which is centrally apertured, as at 54, to receive a threaded fastener element 56 therethrough. The spikes 42, 44, 46, 48 and 50 extend outwardly from the body 52 and the inner surface of the body 52 is curved along a cylindrical plane corresponding with the exterior periphery of the cylindrical member 26. The threaded fastener 56 is preferably in the form of a large headed bolt which extends not only through the opening 54 in the spike cluster body 52, but through a registering opening 58 extending through the cylindrical member 26. A cooperating threaded nut element 60 serves to retain the spike cluster with its concave surface in engagement with the exterior periphery of the cylinder member in a particular arrangement. In the preferred arrangement shown, the spike 42 is positioned in alignment with a plane perpendicular to the axis of the cylindrical member 26 and coincident with the axis of the centrally located threaded fastener element 56. The spikes 44 and 46 are spaced on opposite sides of the aforesaid plane in equally spaced relation and in arcuate or angular alignment with one another. The other two spikes 48 and 50 are likewise spaced equally on opposite sides of the aforesaid plane, however their spacing is one-half the spacing of the spikes 44 and 46. The spikes 48 and 50 are aligned in an angular direction with respect to the periphery of the cylindrical member, the position of the spikes 44 and 46 in this direction being generally equally spaced between the angular position of the spike 42 and the angular position of the aligned spikes 48 and 50.

It is of significant importance to note that each of the spikes provides a cutting edge consisting of two lines defining a plus-shaped configuration, the two lines intersecting at their mid-points. The orientation of each spike is such that one of the lines is either disposed within the aforesaid plane or parallel thereto while the other line is perpendicular to the aforesaid plane. It will also be noted that each spike diverges from the plus-shaped cutting edge thereof in a direction toward the periphery of the cylindrical member 26 or the body portion 52 of the associated cluster.

Figures 3, 4:
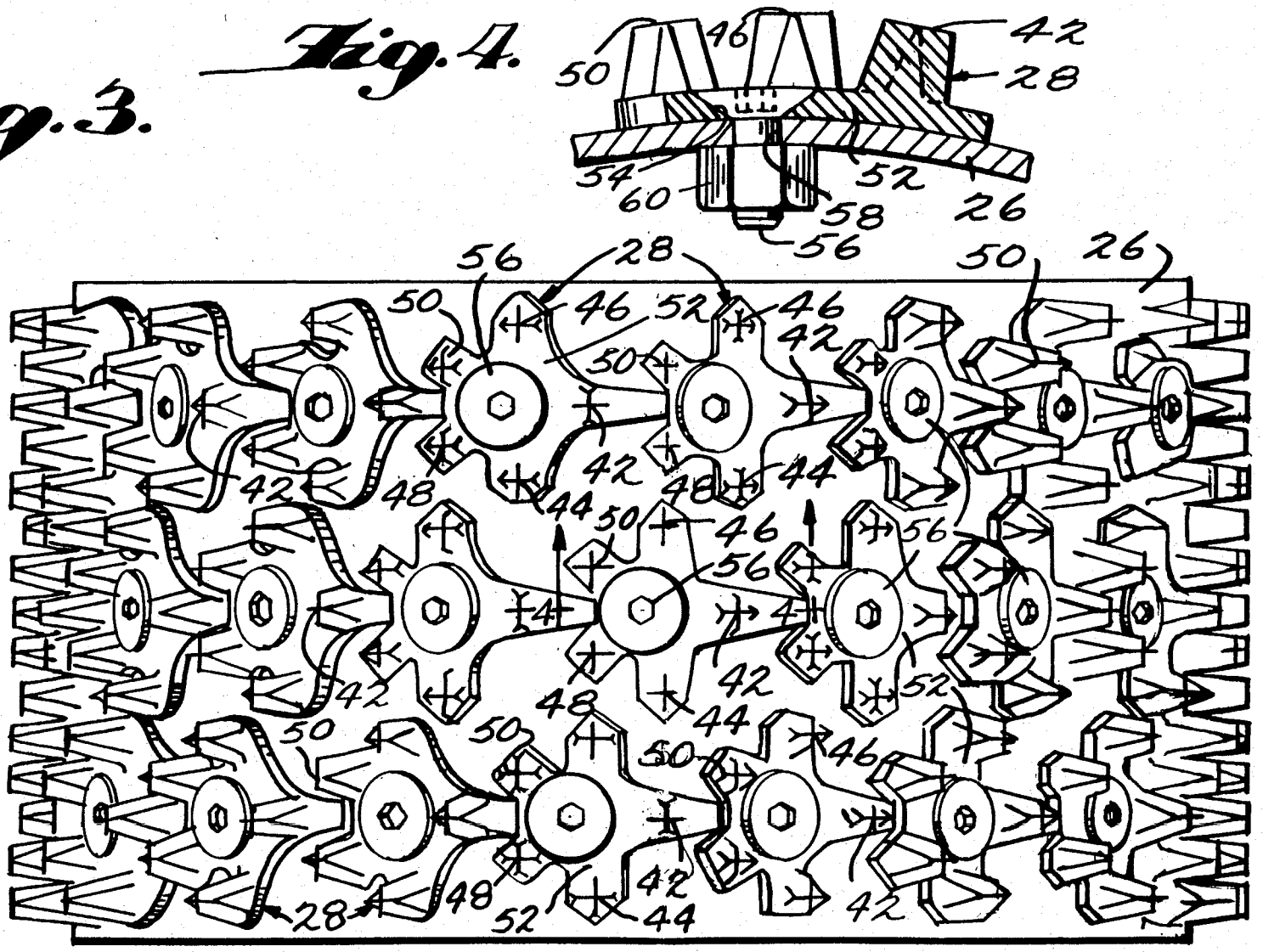
FIG. 3 is an enlarged side elevational view of a feed roll embodying the improvements of the present invention.
FIG. 4 is an enlarged fragmentary sectional view taken along the line 4—4 of FIG. 3.

Finally, with respect to FIG. 3, it will be noted that the clusters are arranged on the exterior periphery in three annular rows, there being 16 clusters in each row so that the axis of the fastener associated with each cluster is displaced angularly with respect to the adjacent cluster of the row approximately $22\frac{1}{2}°$. The clusters of each row are angularly offset with respect to the clusters of the adjacent row. The angular offset is equal to the angular spacing of the intermediate spikes 44 and 46 with respect to either spike 42 or spikes 48 and 50. With this angular offset, the individual spikes of each annular row become aligned in transversely extending rows with each row containing a spike 42 of one cluster, a pair of spikes 44 and 46 of another cluster and a pair of spikes 48 and 50 of another cluster. With this arrangement, an equal number of spikes is contained in each transverse row. However, the spacing is irregular and varies periodically every third row in such a way that for every $22\frac{1}{2}°$ of turn of the roll a log capable of being contacted through the periphery of the roll would be contacted by 15 spikes at 15 equidistantly spaced-apart transverse positions.

While the cluster construction and arrangement of clusters described above is preferred, the construction of primary importance is the two line cutting edge configuration of the spikes and specifically the plus-shaped configuration described above. The two line cutting edge configuration greatly enhances the contact area of each spike as compared with the conventional conical configuration and thus greatly enhances the torque transmitting capacity of the spikes. Moreover, the configuration minimizes the possibility of slippage and therefore minimizes the type of snowballing wear prevalent with conventional conical spikes. Other configuations which include cutting edges defining at least two transversely related lines are possible, such as an L, H, or Y, or combinations thereof. The plus configuration is preferred as it presents a symmetrical arrangement with the least possibility of material, such as ice or the like, becoming clogged within the angularly related faces of the spikes.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a debarking machine of the type including an annular frame, a plurality of debarking tools, means mounting said tools in annularly spaced relation within said annular frame for rotation together about the axis of said annular frame and for movement toward and away from each other, infeed and outfeed mechanisms for feeding logs through said annular frame so that said tools will engage the exterior periphery of the successive logs and strip the bark therefrom during their movement through the annular frame, said infeed mechanism including three driven infeed spiked rolls arranged so that their spiked peripheries normally engage the exterior periphery of the log in centered relation and move the same axially through said annular frame for debarking by said tools, each of said spiked rolls including a cylinder and a multiplicity of spikes extending radially outwardly therefrom, the improvement which comprises:

each of said spikes in at least one of said rolls being constructed so as to provide a radially outward cutting edge disposed generally within a plane parallel with the plane of said cylinder, said cutting edge being configured to define at least one line extending transverse to the direction of movement thereof on said roll and a second line extending transverse to said first line, said spike divergingly tapering from said lines in a direction toward the exterior of said cylinder.

2. The improvement as defined in claim 1 wherein said first and second lines are in the form of a plus sign.

3. The improvement as defined in claim 2 wherein said spikes are arranged on the exterior periphery of said cylinder in annularly spaced transversely extending rows, the spikes of each row being transversely staggered with respect to the spikes of the rows adjacent thereto.

4. The improvement as defined in claim 3 wherein each spike constitutes one of a cluster of spikes formed as an integral assembly.

5. The improvement as defined in claim 4 wherein each cluster of spikes includes five spikes arranged so that two pairs of spikes are disposed respectively in two adjacent rows of spikes and the fifth spike is disposed in a third row adjacent to one of the two adjacent rows.

6. The improvement as defined in claim 5 wherein each fifth spike is centered transversely with respect to each pair of said two pairs of spikes.

7. The improvement as defined in claim 6 wherein a first pair of spikes of said two pairs of spikes which is adjacent said fifth spike is spaced transversely apart a distance greater than the transverse spacing between the second pair of spikes.

8. The improvement as defined in claim 7 wherein each cluster of spikes is fixed to the periphery of the associated cylinder by fastener means.

9. The improvement as defined in claim 8 wherein said fastener means includes a single centrally located bolt, each cluster having a portion abuttingly engaging an adjacent cluster so as to positively prevent rotational movement thereof about the single bolt as an axis.

10. The improvement as defined in claim 7 wherein said clusters of spikes are mounted on the periphery of the associated cylinder in transversely aligned and annularly staggered relation with respect to each other so that each row of spikes includes a fifth spike in one cluster, a first pair of spikes in a second cluster and a second pair of spikes in a third cluster.

11. The improvement as defined in claim 1 wherein each spike constitutes one of a cluster of spikes formed as an integral assembly.

12. The improvement as defined in claim 11 wherein each cluster of spikes includes five spikes arranged so that two pairs of spikes are disposed respectively in two adjacent rows of spikes and the fifth spike is disposed in a third row adjacent to one of the two adjacent rows.

13. The improvement as defined in claim 12 wherein each fifth spike is centered transversely with respect to each pair of said two pairs of spikes.

14. The improvement as defined in claim 13 wherein a first pair of spikes of said two pairs of spikes which is adjacent said fifth spike is spaced transversely apart a distance greater than the transverse spacing between the second pair of spikes.

15. The improvement as defined in claim 14 wherein said clusters of spikes are mounted on the periphery of the associated cylinder in transversely aligned and annularly staggered relation with respect to each other so that each row of spikes includes a fifth spike in one cluster, a first pair of spikes in a second cluster and a second pair of spikes in a third cluster.

16. The improvement as defined in claim 1 wherein each cluster of spikes is fixed to the periphery of the associated cylinder by fastener means.

17. The improvement as defined in claim 16 wherein said fastener means includes a single centrally located bolt, each cluster having a portion abuttingly engaging an adjacent cluster so as to positively prevent rotational movement thereof about the single bolt as an axis.

18. The improvement as defined in claim 1 wherein said spikes are arranged on the exterior periphery of said cylinder in annularly spaced transversely extending rows, the spikes of each row being transversely staggered with respect to the spikes of the rows adjacent thereto.

* * * * *